US011680740B2

(12) United States Patent
Kim et al.

(10) Patent No.: US 11,680,740 B2
(45) Date of Patent: Jun. 20, 2023

(54) GAS-LIQUID SEPARATOR AND AIR CONDITIONER HAVING THE SAME

(71) Applicant: LG Electronics Inc., Seoul (KR)

(72) Inventors: Eungsu Kim, Seoul (KR); Eunjun Cho, Seoul (KR); Sungheon Ryu, Seoul (KR); Jusang Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 17/067,042

(22) Filed: Oct. 9, 2020

(65) Prior Publication Data

US 2021/0123646 A1 Apr. 29, 2021

(30) Foreign Application Priority Data

Oct. 23, 2019 (KR) ..... 10-2019-0132094

(51) Int. Cl.
*F25B 49/02* (2006.01)
*F25B 41/40* (2021.01)
(Continued)

(52) U.S. Cl.
CPC ..... *F25B 49/02* (2013.01); *F25B 39/00* (2013.01); *F25B 40/02* (2013.01); *F25B 41/22* (2021.01); *F25B 41/40* (2021.01); *F25B 2400/0409* (2013.01); *F25B 2400/23* (2013.01); *F25B 2600/2515* (2013.01); *F25B 2700/13* (2013.01);
(Continued)

(58) Field of Classification Search
CPC ..... F25B 49/02; F25B 41/40; F25B 41/42; F25B 41/22; F25B 40/02; F25B 39/00; F25B 39/02; F25B 2400/0409; F25B 2400/23; F25B 2600/2515; F25B 2600/2501; F25B 2700/13;
(Continued)

(56) References Cited

U.S. PATENT DOCUMENTS 11,441,793 B2 * 9/2022 Cho ..... F24F 11/81
2012/0118533 A1 * 5/2012 Jang ..... F28F 27/02 165/96
(Continued)

FOREIGN PATENT DOCUMENTS

EP 3511655 A 7/2019
JP H04263746 A 9/1992
(Continued)

OTHER PUBLICATIONS

English Translation of Cho et al. (KR 20180104416 A) (Year: 2018).*
(Continued)

*Primary Examiner* — Miguel A Diaz
(74) *Attorney, Agent, or Firm* — Fish & Richardson P.C.

(57) ABSTRACT

Provided is a gas-liquid separator, including a connection pipe connected to a refrigerant pipe in the evaporator, the refrigerant pipe in which a two-phase refrigerant flows, a header connected to the connection pipe, wherein a gas refrigerant separated from the two-phase refrigerant flows inside the header, a bypass pipe connected to the header to guide a flow of the gas refrigerant to a compressor, a flow rate control valve installed at the bypass pipe, and a controller configured to control opening and closing of the flow rate control valve based on whether a preset condition is satisfied.

19 Claims, 9 Drawing Sheets

(51) Int. Cl.
*F25B 41/22* (2021.01)
*F25B 39/00* (2006.01)
*F25B 40/02* (2006.01)

(52) U.S. Cl.
CPC ..... *F25B 2700/2106* (2013.01); *F25B 2700/2115* (2013.01); *F25B 2700/2116* (2013.01)

(58) Field of Classification Search
CPC ..... F25B 2700/2106; F25B 2700/2115; F25B 2700/2116
See application file for complete search history.

(56) References Cited

U.S. PATENT DOCUMENTS

2020/0149751 A1* 5/2020 Cho ..... F25B 13/00
2020/0182564 A1* 6/2020 Onaka ..... F28F 9/02
2020/0318870 A1* 10/2020 Cho ..... F28D 1/0417

FOREIGN PATENT DOCUMENTS

JP H05203270 A 8/1993
JP 2006125793 A 5/2006
KR 1020180104416 9/2018
KR 1020200053269 5/2020
KR 1020200059578 5/2020
WO WO-2016103599 A1 * 6/2016 ..... B60H 1/00921

OTHER PUBLICATIONS

EP Extended European Search Report in European Appln. No. 20202201.8, dated Jun. 15, 2021, 3 pages.

* cited by examiner

GAS-LIQUID SEPARATOR AND AIR CONDITIONER HAVING THE SAME

CROSS-REFERENCE TO RELATED APPLICATION

This application claims the benefit of Korean Patent Application No. 10-2019-0132094, filed on Oct. 23, 2019, the disclosure of which is incorporated herein in its entirety by reference.

BACKGROUND

1. Field

The present disclosure relates to a gas-liquid separator and an air conditioner including the same, and one particular embodiment relates to a gas-liquid separator for separating a gas refrigerant from a two-phase refrigerant flowing inside an evaporator and an air conditioner including the same.

2. Description of the Related Art

In general, an air conditioner is a device for cooling or heating indoor air using a refrigeration cycle device that is composed of a compressor, an outdoor heat exchanger, an expansion device, and an indoor heat exchanger.

In the case of cooling indoor air, the outdoor heat exchanger functions as a condenser, the indoor heat exchanger functions as an evaporator, and refrigerant is circulated in the order of the compressor, the outdoor heat exchanger, the expansion device, the indoor heat exchanger, and the compressor.

In the case of heating indoor air, the outdoor heat exchanger functions as an evaporator, the indoor heat exchanger functions as a condenser, and refrigerant is circulated in the order of the compressor, the indoor heat exchanger, the expansion mechanism, the outdoor heat exchanger, and the compressor.

Related patent document 1 (Korea Patent Application Publication No. 10-2018-0136693) relates to a technology for improving heating performance by reducing a refrigerant pressure loss in a cold region, related patent document 2 (Korean Patent Application Publication No. 10-2017-0031139) relates to a technology for improving operation performance of an outdoor heat exchanger by allowing refrigerant to move smoothly at a low outside temperature, and related patent document 3 (Korean Patent Application Publication No. 10-2018-0144475) relates to an air conditioner capable of two-stage cooling of refrigerant passing through an inner pipe by refrigerant introduced through a different path.

The pressure loss in the evaporator of the air conditioner may cause several problems. Accordingly, if a gas refrigerant is extracted from a two-phase refrigerant flowing inside the evaporator and then guided to the compressor, the efficiency of the air conditioner may be improved due to a pressure loss reduction. Thus, a technique for controlling the opening and closing of a flow rate control valve is required.

SUMMARY

An aspect provides a technique related to a gas-liquid separator for separating a gas refrigerant from a two-phase refrigerant flowing inside an evaporator and an air conditioner including the gas-liquid separator. It will be appreciated by persons skilled in the art that the objects that could be achieved with the present disclosure are not limited to what has been particularly described hereinabove and the above and other objects that the present disclosure could achieve will be more clearly understood from the following detailed description.

According to an aspect, there is provided an air conditioner including a gas-liquid separator including a connection pipe connected to a refrigerant pipe in an evaporator, the refrigerant pipe in which a two-phase refrigerant flows, a header connected to the connection pipe, wherein a gas refrigerant separated from the two-phase refrigerant flows inside the header, a bypass pipe connected to the header to guide a flow of the gas refrigerant to a compressor, a flow rate control valve installed at the bypass pipe, and a controller configured to control opening and closing of the flow rate control valve based on whether a preset condition is satisfied.

According to another aspect, there is provided an air conditioner having a compressor for compressing a refrigerant, a condenser for condensing a refrigerant compressed in the compressor, a subcooler for subcooling a refrigerant passing through the condenser, and an evaporator for evaporating a refrigerant passing through the subcooler. The air conditioner may further include a bypass pipe for guiding a flow of a gas refrigerant separated from a two-phase refrigerant, flowing inside a refrigerant pipe of the evaporator, to the compressor, a flow rate control valve installed at the bypass pipe, and a controller configured to control opening and closing of the flow rate control valve based on whether at least one of a first condition, a second condition, a third condition, and a fourth condition is satisfied. The first condition may be associated with an outside temperature of the air conditioner, the second condition may be associated with an operation of the air conditioner, the third condition may be associated with a degree of discharge superheat determined based on a temperature measured in the compressor and a temperature measured in the condenser, and the fourth condition may be associated with a refrigerant flow velocity of the two-phase refrigerant.

Specific details of other embodiments are included in the detailed description and drawings.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION

Figure 1:
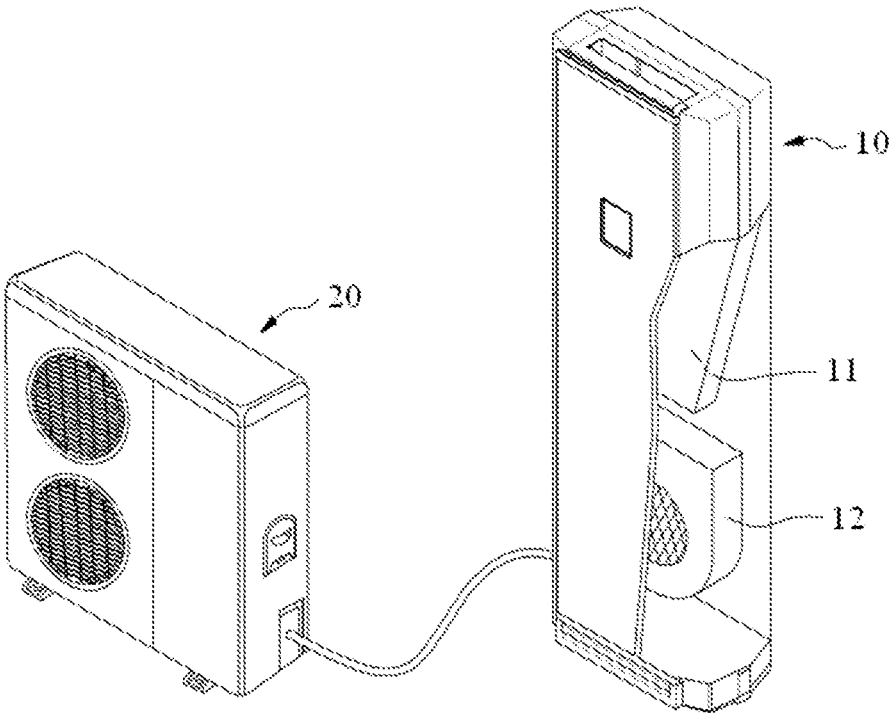
FIG. 1 is a diagram illustrating an air conditioner including an indoor unit and an outdoor unit according to an embodiment.

Hereinafter, embodiments of the present disclosure will be described in detail with reference to the accompanying drawings.

Hereinafter, exemplary embodiments disclosed herein will be described in detail with reference to the accompanying drawings, but the same or similar elements are assigned the same reference numbers regardless of the reference numerals, and overlapping descriptions thereof will be omitted. The suffixes "module" and "part" for components used in the following description are given or mixed only considering the ease of writing the specification, and do not have meanings or roles that are distinguished from each other. In addition, in the description of the embodiments disclosed herein, when it is determined that detailed descriptions of related known technologies may obscure the gist of the embodiments disclosed herein, detailed descriptions thereof will be omitted. In addition, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Terms including ordinal numbers such as first and second may be used to describe various components, but the components are not limited by the terms. The terms are used only for the purpose of distinguishing one component from other components.

When an element is said to be "connected" or "connected" to another component, it is understood that other components may be directly connected to or connected to the other component, but there may be other components in between. On the other hand, when a component is said to be "directly connected" or "directly connected" to another component, it should be understood that no other component exists in the middle.

Singular expressions include plural expressions unless the context clearly indicates otherwise.

In this application, terms such as "comprises" or "have" are intended to indicate that a feature, number, step, operation, component, part, or combination thereof described in the specification exists, and that one or more other features are present. It should be understood that the existence or addition possibilities of fields or numbers, steps, operations, components, parts or combinations thereof are not excluded in advance.

In describing the embodiments, descriptions of technical contents well known in the technical field to which the present disclosure pertains and which are not directly related to the present disclosure will be omitted. This is to more clearly and without obscuring the subject matter of the present disclosure by omitting unnecessary description.

For the same reason, some components in the accompanying drawings are exaggerated, omitted, or schematically illustrated. Also, the size of each component does not entirely reflect the actual size. The same reference numbers are assigned to the same or corresponding elements in each drawing.

Advantages and features of the present disclosure, and a method of achieving them will be apparent with reference to embodiments described below in detail together with the accompanying drawings. However, the present disclosure is not limited to the embodiments disclosed below, and may be implemented in various different forms, and only the embodiments allow the disclosure of the present disclosure to be complete, and common knowledge in the technical field to which the present disclosure pertains. It is provided to fully inform the holder of the scope of the disclosure, and the disclosure is only defined by the scope of the claims. The same reference numerals refer to the same components throughout the specification.

FIG. 1 is a diagram illustrating an air conditioner including an indoor unit and an outdoor unit according to an embodiment.

Referring to FIG. 1, an air conditioner may include an indoor unit 10 and an outdoor unit 20. In the air conditioner, the indoor unit 10 is depicted as a standing type, but may be a wall-mounted type or a ceiling-mounted type. The indoor unit 10 is not limited to a standing type, a wall-mounted type, or a ceiling type, and may be installed indoors in any of various shapes.

The outdoor unit 20 may be connected to the indoor unit 10 and transfer refrigerant necessary for air conditioning in the indoor unit 10 to the indoor unit 10. The indoor unit 10 may exchange heat between the transferred refrigerant and air, and discharge the heat-exchanged air into an indoor space.

The indoor unit 10 and the outdoor unit 20 may be connected through a refrigerant pipe so that a refrigerant circulates through the indoor unit 10 and the outdoor unit 20 via the refrigerant pipe. Hot or cold air may be discharged into the indoor space from the indoor unit 10 that performs a heating operation or a cooling operation according to circulation of the refrigerant. At this point, at least one indoor unit 10 may be connected to the outdoor unit 20, and FIG. 1 shows connection between one outdoor unit 20 and one indoor unit 10 as an example.

The indoor unit 10 and the outdoor unit 20 may be connected via a cable for communication, and hence, control commands may be transmitted or received according to a predetermined communication method.

The indoor unit 10 may include an inlet for suctioning indoor air, and an outlet for discharging heat-exchanged air from an inside. The indoor unit 10 may include an air direction control apparatus provided in the outlet. The air direction control apparatus may open and close the outlet or may control a direction of air discharged from the outlet. In addition, the indoor unit 10 may control a volume of air discharged from the outlet. The indoor unit 10 may include a vane installed at the inlet or the outlet. The vane may open and close at least one of the inlet and the outlet, and may guide an air flow direction.

The indoor unit 10 may further include a display for displaying an operating state and setting information of the indoor unit 10, and an input part for inputting setting data. When the user inputs an operation command for the air conditioner through the input part, the outdoor unit 20 may be operated for a cooling operation or a heating operation in response to the input operation command. At this point, the user may input an operation command for the air conditioner manually or through communication.

When the air conditioner is in a cooling operation, the outdoor heat exchanger included in the outdoor unit may function as a condenser in which a gas refrigerant flowing to the outdoor heat exchanger can be condensed by outdoor air. Also, when the air conditioner is in a heating operation, the outdoor heat exchanger may function as an evaporator in which a liquid refrigerant flowing into the outdoor heat exchanger can be evaporated by outdoor air.

The indoor unit may include an indoor heat exchanger 11 for allowing heat exchange between indoor air and a refrigerant, and an indoor blower 12 for blowing the indoor air to the indoor heat exchanger 11. When the air conditioner is in a cooling operation, the indoor heat exchanger included in the indoor unit may function as an evaporator in which a liquid refrigerant flowing to the indoor heat exchanger can be evaporated by indoor air. In addition, when the air conditioner is in a heating operation, the indoor heat exchanger included in the indoor unit may function as a condenser in which a gas refrigerant flowing to the indoor heat exchanger can be condensed by indoor air.

Figure 2:
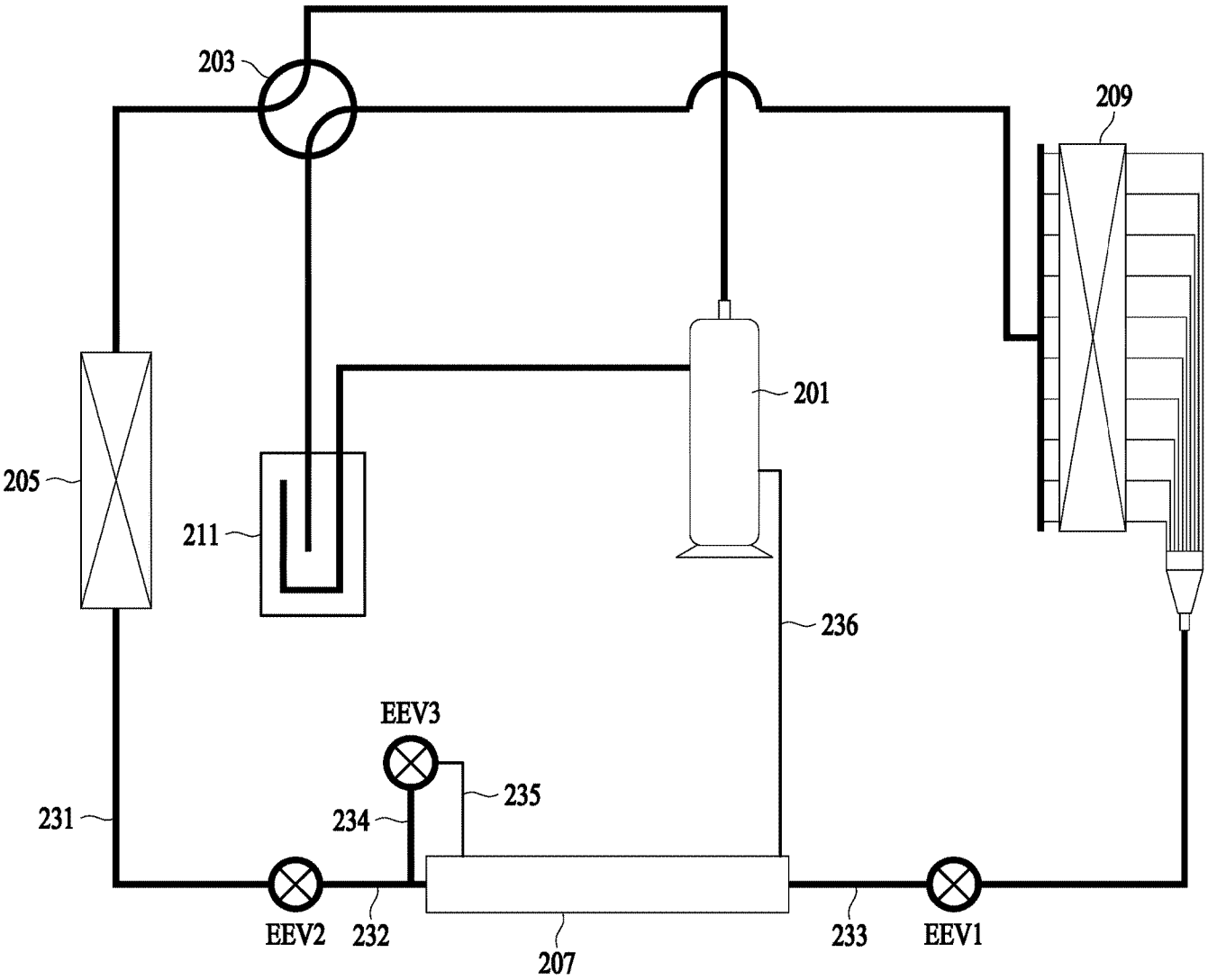
FIG. 2 is a diagram showing a system of the air conditioner of FIG. 1 according to an embodiment.

FIG. 2 is a diagram showing a system of the air conditioner of FIG. 1 according to an embodiment.

The air conditioner may be operated by a compressor 201, a four way valve 203, a condenser 205, a flow rate control valve, a subcooler 207, an evaporator 209, and an accumulator 211.

According to an embodiment, when the air conditioner is in a heating operation, the indoor unit may include the condenser 205 which corresponds to an indoor heat exchanger, and the outdoor unit may include the outdoor heat exchanger evaporator 209, the compressor 201, the four way valve 203, the subcooler 207, and the accumulator 211. The four way valve 203 may allow a refrigerant discharged from the compressor 201 to flow either into the outdoor heat exchanger or into the indoor heat exchanger. The indoor unit and the outdoor unit are merely examples, and the air conditioner is not limited thereto.

The accumulator 211 may separate a gas refrigerant from a two-phase refrigerant that includes a liquid refrigerant and the gas refrigerant. The liquid refrigerant separated in the accumulator 211 may be received in a lower side of the accumulator 211, and the gas refrigerant may be received above the separated liquid refrigerant. The gas refrigerant separated in the accumulator 211 may flow to the compressor 201, and the liquid refrigerant separated in the accumulator 211 may remain in the accumulator 211.

When the air conditioner is in a heating operation, a refrigerant may pass through the compressor 201 and the indoor heat exchanger 205, expand in an electronic expansion device, and be then heat exchanged with outdoor air in the outdoor heat exchanger 209.

Specifically, when the air conditioner is in the heating operation, a refrigerant discharged from the compressor may flow to the indoor heat exchanger 205 by the four way valve 203. The refrigerant condensed in the indoor heat exchanger 205 may be subcooled in the subcooler 207 and then flow to the outdoor heat exchanger 209.

The refrigerant condensed in the indoor heat exchanger 205 may flow through a refrigerant pipe 231. The refrigerant may flow to the subcooler 207 through a refrigerant pipe 232. The refrigerant pipe 232 may be connected to the subcooler 207 to guide the refrigerant transferred from the refrigerant pipe 231 to the subcooler 207, and a refrigerant pipe 233 may guide discharge of a refrigerant which is heat-exchanged in the subcooler 207. Hereinafter, the refrigerant flowing inside the refrigerant pipe 232 and the refrigerant pipe 233 will be referred to as a first refrigerant.

In some examples, the subcooler 207 can include a heat exchanger or a refrigerant passage or pipe configured to exchange heat with the refrigerant that has passed through the refrigerant pipe 231. In some examples, the subcooler 207 can be a portion of a refrigerant pipe that carries a liquid-phase refrigerant, a gas-phase refrigerant, or both.

An opening degree of each of a first electronic expansion valve EEV1 and a second electronic expansion valve EEV2 may be adjusted to or not to expand a refrigerant flowing therein. In a heating operation, the second electronic expansion valve EEV2 may be opened, and an opening degree of the first electronic expansion valve EEV1 may be adjusted. The second electronic expansion valve EEV2 may be installed at a refrigerant pipe between the indoor heat exchanger 205 and the subcooler 207, and the first electronic expansion valve EEV1 may be installed at a refrigerant pipe between the outdoor heat exchanger 209 and the subcooler 207.

In order to inject refrigerant into the compressor 201, a portion of the first refrigerant may be branched by a refrigerant pipe 234. Hereinafter, the portion branched from the first refrigerant will be referred to as a second refrigerant.

The second refrigerant may flow through the refrigerant pipe 234 to a third electronic expansion valve EEV3, and may flow from the electronic expansion valve EEV3 to a refrigerant pipe 235 through the subcooler 207. The refrigerant discharged from the subcooler 207 through a refrigerant pipe 236, which connects the subcooler 207 and the compressor 201, may flow to the compressor 201. Therefore, the refrigerant discharged from the subcooler 207 may be injected into the compressor 201.

The first refrigerant may flow through a plurality of inner tubes inside the subcooler, and the second refrigerant may flow through an outer tube. At this point, the plurality of inner tubes may be arranged in the inner space of the subcooler 207, and the first refrigerant flowing inside the plurality of inner tubes may be subject to heat exchange with the second refrigerant flowing inside the outer tube.

The second refrigerant may be expanded by the electronic expansion valve EEV3 to have a lower temperature and a lower pressure compared to the first refrigerant. The second refrigerant of the low temperature and the low pressure may be, while flowing inside the outer tube, heat exchanged with the first refrigerant which flows inside the plurality of inner tubes, and the first refrigerant may be subcooled. The first refrigerant may be heat exchanged with the indoor air, thereby being evaporated in the outdoor heat exchanger 209.

According to another embodiment, when the air conditioner is in a cooling operation, the indoor unit may include an evaporator 209 which corresponds to the indoor heat exchanger, and the outdoor unit may include a condenser 205 corresponding to the outdoor heat exchanger, a compressor 201, a four way valve 203, a subcooler 207, and an accumulator 211. The indoor unit and the outdoor unit are merely examples, and the air conditioner is not limited thereto.

The accumulator 211 may separate a gas refrigerant from a two-phase refrigerant that includes a liquid refrigerant and the gas refrigerant. The liquid refrigerant separated in the accumulator 211 may be received in a lower side of the accumulator 211, and the gas refrigerant may be received above the separated liquid refrigerant. The gas refrigerant separated in the accumulator 211 may flow to the compressor 201, and the liquid refrigerant separated in the accumulator 211 may remain in the accumulator 211.

When the air conditioner is in a cooling operation, a refrigerant may pass through the compressor 201 and the outdoor heat exchanger 205, expand in an electronic expansion device, and be then heat exchanged with indoor air in the indoor heat exchanger 209.

Specifically, when the air conditioner is in the cooling operation, a refrigerant discharged from the compressor 201 may flow to the outdoor heat exchanger 205 by the four way valve 203. The refrigerant condensed in the outdoor heat exchanger 205 may be subcooled by the subcooler 207 and then flow to the indoor heat exchanger 209.

The refrigerant condensed by the outdoor heat exchanger 205 may flow through the refrigerant pipe 231. The refrigerant expanded by the second electronic expansion valve EEV2 may flow to the subcooler 207 through the refrigerant pipe 232. The refrigerant pipe 232 may be connected to the subcooler 207 to guide the refrigerant transferred from the refrigerant pipe 231 to the subcooler 207, and the refrigerant pipe 233 may guide refrigerant heat-exchanged in the subcooler 207 to be discharged. Hereinafter, the refrigerant flowing inside the refrigerant pipe 232 and the refrigerant pipe 233 will be referred to as a first refrigerant.

An opening degree of each of the first electronic expansion valve EEV1 and the second electronic expansion valve EEV2 may be adjusted to or not to expand a refrigerant flowing therein. In a cooling operation, the first electronic expansion valve EEV1 may be opened, and an opening degree of the second electronic expansion valve EEV2 may be adjusted. The second electronic expansion valve EEV2 may be installed at a refrigerant pipe between the outdoor heat exchanger 205 and the subcooler 207, and the first electronic expansion valve EEV1 may be installed at a refrigerant pipe between the indoor heat exchanger 209 and the subcooler 207.

In order to inject refrigerant into the compressor 201, a portion of the first refrigerant may be branched by a refrigerant pipe 234. Hereinafter, the portion branched from the first refrigerant will be referred to as a second refrigerant.

The second refrigerant may flow through the refrigerant pipe 234 to a third electronic expansion valve EEV3, and may flow from the electronic expansion valve EEV3 to a refrigerant pipe 235 through the subcooler 207. The refrigerant discharged from the subcooler 207 through a refrigerant pipe 236, which connects the subcooler 207 and the compressor 201, may flow to the compressor 201. Therefore, the refrigerant discharged from the subcooler 207 may be injected into the compressor 201.

The first refrigerant may flow through a plurality of inner tubes inside the subcooler, and the second refrigerant may flow through an outer tube. At this point, the plurality of inner tubes may be arranged in the inner space of the subcooler 207, and the first refrigerant flowing inside the plurality of inner tubes may be subject to heat exchange with the second refrigerant flowing inside the outer tube.

The second refrigerant may be expanded by the electronic expansion valve EEV3 to have a lower temperature and a lower pressure compared to the first refrigerant. The second refrigerant of the low temperature and the low pressure may be, while flowing inside the outer tube, heat exchanged with the first refrigerant which flows inside the plurality of inner tubes, and the first refrigerant may be subcooled. The first refrigerant may be heat exchanged with indoor air and evaporated in the indoor heat exchanger 209.

Figure 3:
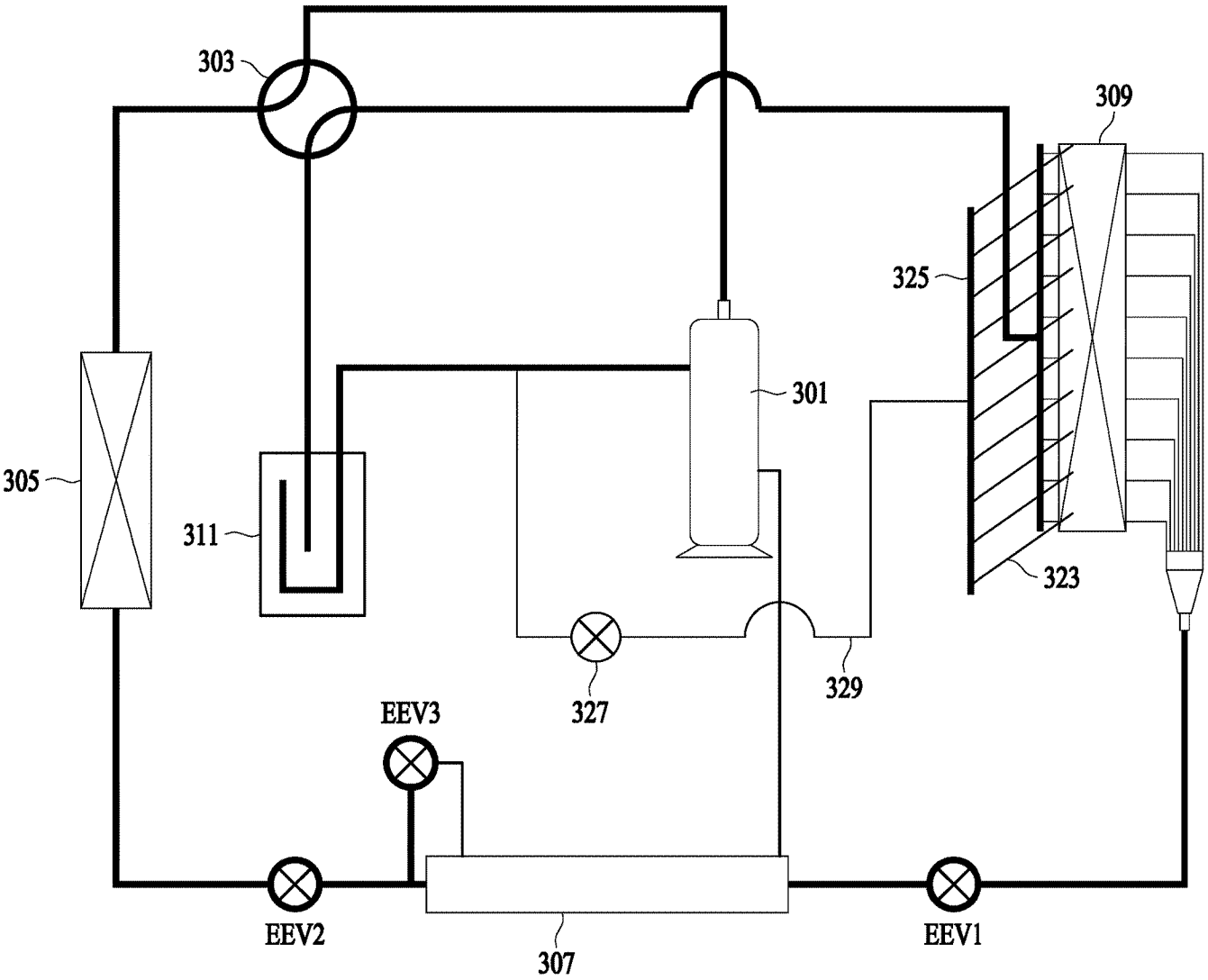
FIG. 3 is a diagram illustrating a system of the air conditioner of FIG. 1 according to another embodiment.

FIG. 3 is a diagram illustrating a system of the air conditioner of FIG. 1 according to another embodiment.

When the air conditioner is in a heating operation, the indoor unit may include a condenser 305 which corresponds to an indoor heat exchanger, and the outdoor unit may include an evaporator 309 which corresponds to an outdoor heat exchanger, a compressor 301, a four way valve 303, a subcooler 307, an accumulator 311. A refrigerant compressed by the compressor 301 may flow to the indoor heat exchanger 305 by the four way valve 303. The refrigerant discharged from the indoor heat exchanger 305 may flow to the subcooler 307, and refrigerant discharged from the subcooler 307 may flow to the outdoor heat exchanger 309. For more details regarding the above, the description of FIG. 2 may be referred to.

In this case, the evaporator, which corresponds to the outdoor heat exchanger 309, may evaporate a liquid refrigerant into a gas refrigerant through heat exchange with outdoor air.

The gas-liquid separator may separate the gas refrigerant in the evaporator 309 and guide the gas refrigerant to the compressor 301. The gas-liquid separator may include a connection pipe 323 connected to a refrigerant pipe in the evaporator, the refrigerant pipe in which the two-phase refrigerant flows. Here, the two-phase refrigerant may include the liquid refrigerant and the gas refrigerant. For more details about the connection pipe 323 connected to the refrigerant pipe through which the two-phase refrigerant flows, FIG. 4 may be referred to.

The gas-liquid separator may include at least one of: the connection pipe 323, a header 325, a flow rate control valve 327, and a bypass pipe 329. The flow rate control valve 327, which is a valve capable of controlling a flow rate of a refrigerant flowing through the bypass pipe 329, may include, for example, an electronic expansion valve (EEV) or a solenoid valve. The gas-liquid separator may further include a controller (not shown).

A plurality of connection pipes 323 may be connected to the header 325, and the header 325 may be connected to the bypass pipe 329 that guides a flow of a gas refrigerant to the compressor 301. The flow rate control valve 327 may be installed at the bypass pipe 329. Specifically, when the flow rate control valve 327 is opened, the gas refrigerant may flow to the compressor 301, and when the flow rate control valve 327 is closed, the gas refrigerant cannot flow to the compressor 301.

When a first preset condition is satisfied, the flow rate control valve 327 may be opened, and when a second preset condition is satisfied, the flow rate control valve 327 may be closed. The first preset condition may be a condition for extracting a gas refrigerant from a two-phase refrigerant flowing inside the evaporator 309, and the second preset condition may be a condition for ensuring reliability of the gas-liquid separator. Specifically, when the second preset condition is satisfied, a liquid refrigerant as well as the gas refrigerant may be included, and thus, the reliability of the air conditioner may be deteriorated.

The opening or closing of the flow rate control valve 327 may be adjusted by the controller (not shown). The controller may adjust the opening or closing of the flow rate control valve 327 based on relevant information. A detailed description about how to open and close the flow rate control valve 327 by the controller will be described later.

When the two-phase refrigerant flowing through the refrigerant pipe inside the evaporator 309 flows in the form of an annular flow, the gas refrigerant may be separated from the two-phase refrigerant through a connection pipe 323. The separated gas refrigerant may flow to the compressor 301 through the bypass pipe 329 connected to the header 325. When the flow rate control valve 327 is opened before the annular flow occurs, the liquid refrigerant as well as the gas refrigerant may flow to the compressor 301 through the bypass pipe 329, and thus, the reliability of the air conditioner may be deteriorated. How to maintain the reliability of the air conditioner will be hereinafter described in detail.

Figure 4:
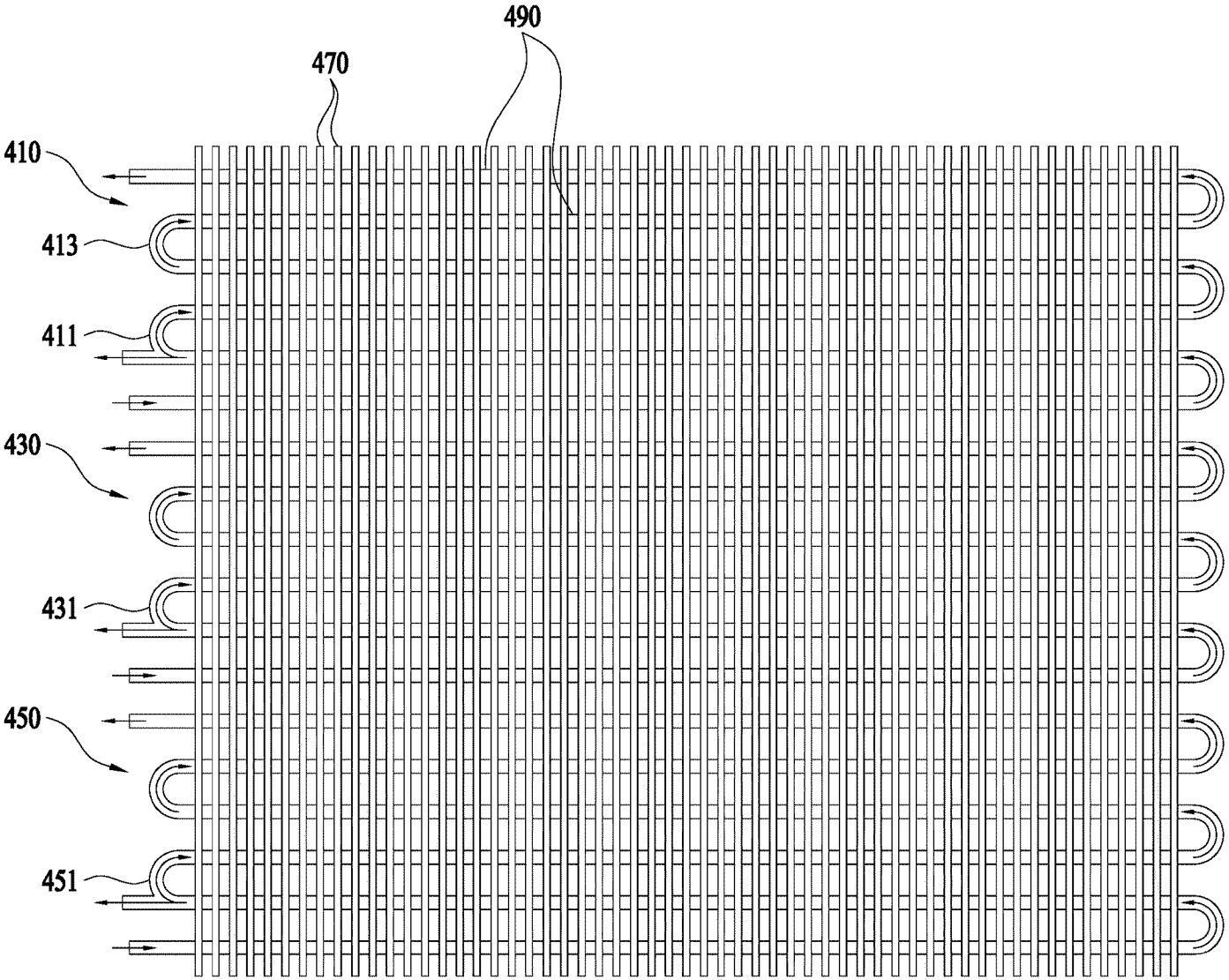
FIG. 4 may be a diagram illustrating a refrigerant pipe of an evaporator according to an embodiment.

FIG. 4 may be a diagram illustrating a refrigerant pipe of an evaporator according to an embodiment.

The evaporator, which corresponds to the outdoor heat exchanger, may include a plurality of refrigerant flow channels 410, 430, and 450, through which a two-phase refrigerant flows, and a plurality of heat exchange pins 470. A plurality of connection pipes 323 of the gas-liquid separator may be connected to a plurality of refrigerant pipes 411, 431, and 451, and a gas refrigerant may be separated from the refrigerant pipes 411, 431, 451 and flow to the plurality of connection pipes 323. Here, the plurality of refrigerant flow channels 410, 430, and 450 shown in FIG. 4, the plurality of heat exchange pins 470, and a plurality of refrigerant straight-type pipes 490 are merely examples, and the scope of the present disclosure is not limited thereto.

The plurality of refrigerant flow channels 410, 430, and 450 may penetrate the plurality of heat exchange pins 470. The plurality of heat exchange pins 470 may have through holes respectively formed therein, and the plurality of refrigerant flow channels 410, 430, and 450 may pass through the respective through holes. In a state in which the plurality of refrigerant flow channels 410, 430, and 450 passes through the respective through holes, outer circumferential surfaces of the plurality of refrigerant flow channels 410, 430, and 450 may contact inner circumferential surfaces of the respective through holes.

The plurality of heat exchange pins 470 may contact air, thereby improving heat exchange performance between a refrigerant flowing inside the plurality of refrigerant flow channels 410, 430, and 450 and air existing outside the plurality of refrigerant flow channels 410, 430, and 450. The plurality of heat exchange pins 470 each may be formed in a quadrilateral shape, for example. The plurality of heat exchange pins 470 may have one surface disposed parallel to one another.

The plurality of connection pipes 323 of the gas-liquid separator may be installed to correspond to the plurality of refrigerant flow channels. For example, if there are ten refrigerant flow channels, the number of the connection pipes 323 may be 10 as shown in FIG. 3, or if there are three refrigerant flow channels 410, 430, and 450, the number of the connection pipes 323 may be 3 as shown in FIG. 4. Alternatively, at least one connection pipe 323 may correspond to one refrigerant flow channel. For example, ten connection pipes 323 of FIG. 3 may be connected to one refrigerant flow channel 410.

The refrigerant flow channel 410 may include the plurality of refrigerant straight-type pipes 490 and a plurality of refrigerant pipes 411 and 413. The plurality of refrigerant straight-type pipes 490 each may be formed straight in a longitudinal direction thereof. The plurality of refrigerant straight-type pipes 490 each may be disposed parallel to one another. The plurality of refrigerant straight-type pipes 490 may pass through the plurality of heat exchange pins 470. The plurality of heat exchange pins 470 may have through holes respectively formed therein, and the plurality of refrigerant straight-type pipes 490 may pass through the respective through holes. In a state in which the plurality of refrigerant straight-type pipes 490 pass through the respective through holes, outer circumferential surfaces of the plurality of refrigerant straight-type pipes 490 may contact inner circumferential surfaces of the respective through holes. The refrigerant pipe 413 included in the refrigerant flow channel 410 may be a U-shaped refrigerant pipe, and the refrigerant pipe 411 included in the refrigerant flow channel 410 may be an h-shaped refrigerant pipe. The U-shaped refrigerant pipe 413 may connect refrigerant pipes 490 adjacent to each other among the plurality of refrigerant pipes 490. At least one h-shaped refrigerant pipe 411 may be disposed at the refrigerant flow channel 410. The gas refrigerant may be separated from the two-phase refrigerant through the refrigerant pipe 411. The refrigerant flow channels 430 and 450 may be applied in the same manner as the refrigerant flow channels 410.

Figure 5:
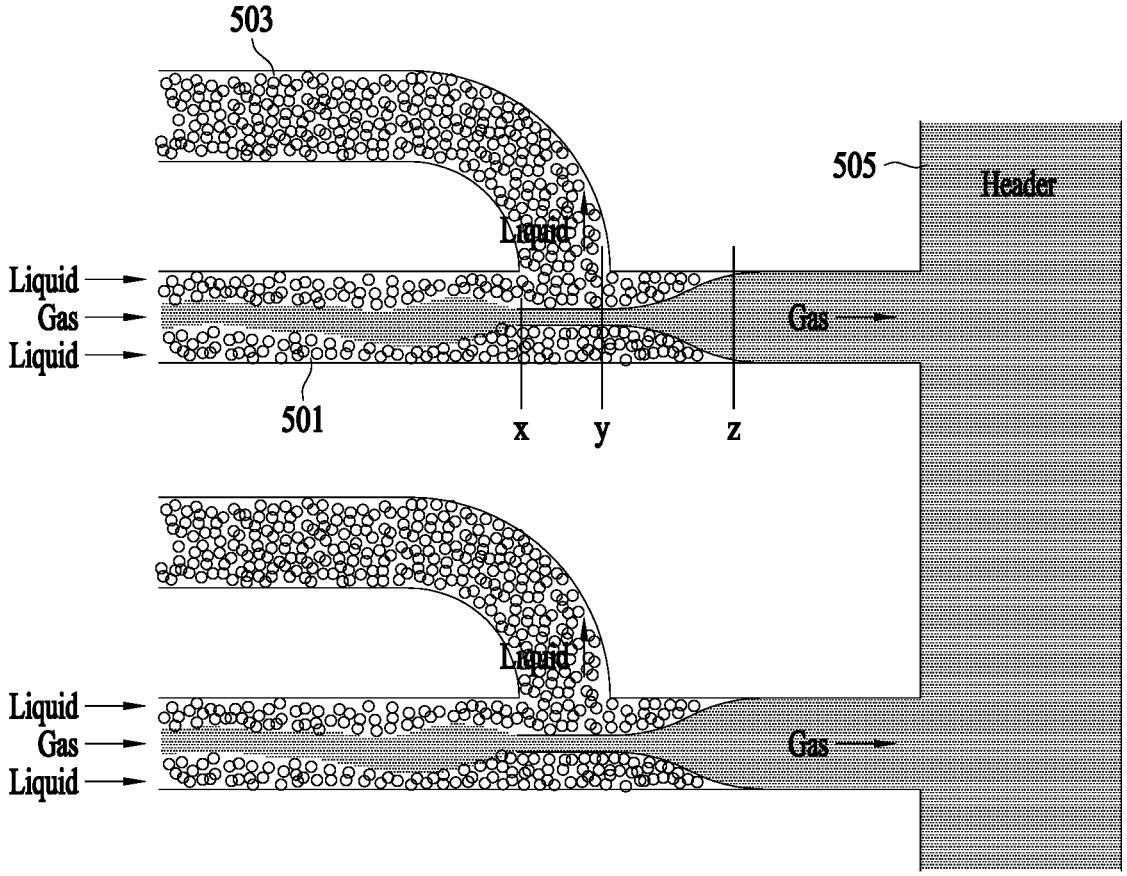
FIG. 5 is a diagram illustrating a flow pattern of a liquid refrigerant and a gas refrigerant according to an embodiment.

FIG. 5 is a diagram illustrating a flow pattern of a liquid refrigerant and a gas refrigerant according to an embodiment.

A flow pattern of a two-phase refrigerant including the liquid refrigerant and the gas refrigerant may change depending on a dryness and a flow velocity. When a constant dryness and a constant flow velocity are ensured, the liquid refrigerant may flow along a wall surface of a refrigerant pipe and the gas refrigerant may flow inside the liquid refrigerant. As a result, the liquid refrigerant and the gas refrigerant may be separated. A flow pattern occurring when a liquid refrigerant and a gas refrigerant are separated and flow inside a refrigerant pipe may be referred to as an annular flow.

When the annular flow occurs, the liquid refrigerant may flow along a wall surface of a refrigerant pipe 501 and the gas refrigerant may flow inside the liquid refrigerant. In this case, the gas refrigerant may flow to a header 505 through a connection pipe, and the liquid refrigerant may flow to a refrigerant pipe 503. A flow pattern such as the annular flow may occur when the two-phase refrigerant flows in a refrigerant pipe at a predetermined flow velocity or higher. A detailed description about an annular flow in which only the gas refrigerant is separated from the two-phase refrigerant flowing inside the refrigerant pipe 501 will be described later.

Figure 6:
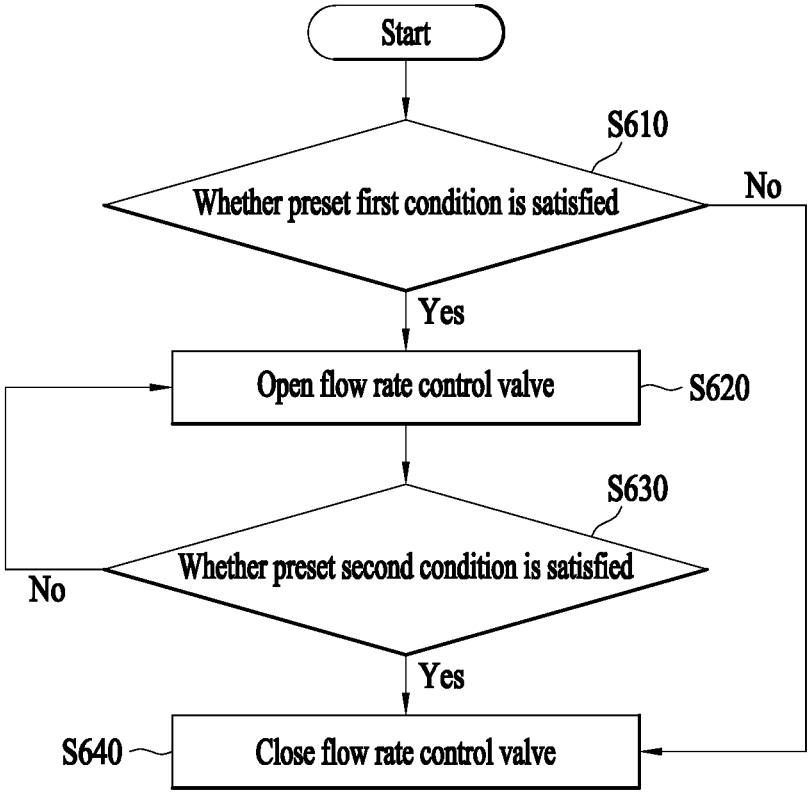
FIG. 6 is a diagram illustrating a control of a flow rate control valve installed on a bypass pipe according to the embodiment.

FIG. 6 is a diagram illustrating a control of a flow rate control valve installed on a bypass pipe according to the embodiment.

An air conditioner may include a compressor for compressing refrigerant, a condenser for condensing refrigerant compressed in the compressor, a subcooler for subcooling refrigerant passing through the condenser, and an evaporator for evaporating refrigerant passing through the subcooler.

At this point, the air conditioner may further include a gas-liquid separator for separating a gas refrigerant from a two-phase refrigerant (including a liquid refrigerant and the gas refrigerant) flowing inside a refrigerant pipe of the evaporator. The gas-liquid separator may include a connection pipe connected to the refrigerant pipe in the evaporator, the refrigerant pipe in which the two-phase refrigerant flows, a header connected to the connection pipe, a bypass pipe connected to the header to guide a flow of the gas refrigerant to the compressor, a flow rate control valve installed on the bypass pipe to control the flow of the gas refrigerant to the compressor, and a controller (not shown).

Opening or closing of the flow rate control valve may be controlled by the controller (not shown). The controller may adjust the opening or closing of the flow rate control valve based on relevant information. Specifically, the controller included in the gas-liquid separator may control the flow rate control valve to be opened or closed according to whether a first preset condition is satisfied in operation S610. When the first preset condition is satisfied, the flow rate control valve may be opened in operation S620, or when a second preset condition is satisfied, the flow rate control valve may be closed in operation S640. When the flow rate control valve is opened in operation S620, the opening or closing of the flow rate control valve may be controlled according to whether the second preset condition is satisfied in operation S630. When the second preset condition is not satisfied, the flow rate control valve may be opened in operation S620, and when the second preset condition is satisfied, the flow rate control valve may be closed in operation S640. The first preset condition and the second preset condition may be related to an outside temperature, a degree of discharge superheat, a refrigerant flow velocity, and elapse of a predetermined period of time. Hereinafter, the above will be described in more detail.

Specifically, a refrigerant flow velocity of a two-phase refrigerant flowing inside an evaporator may be estimated in consideration of at least one of the following: a type of the compressor, a frequency of the compressor, the number of paths of the evaporator, and an outside temperature. Hereinafter, the estimated refrigerant flow velocity will be referred to as a first refrigerant flow velocity. The first refrigerant flow velocity (kg/m2s) may be determined by Equation 1 below.

$$N/P\times((A\times\text{Outside Temperature})+B) \quad \text{Equation 1}$$

Here, N may be determined according to a compressor type, P may be determined as a current number of paths of the evaporator compared to 10 paths, and A and B may be statistical values determined according to a current frequency. For example, if the current number of paths of the evaporator is 12, P may be 1.2, and N may be a predetermined value according to a compressor type. Also, A and B may be determined by Equation 2 below. Here, A1, A2, B1, and B2 may be statistical values determined by experiments.

$$A=A1*\text{Frequency}+A2$$

$$B=B1*\text{Frequency}+B2 \quad \text{Equation 2}$$

A second refrigerant flow velocity may be a flow velocity of the two-phase refrigerant when flowing in the form of an annular flow in the refrigerant pipe of the evaporator, and the second refrigerant flow velocity may be determined by Equation 3 below. Here, C and D may be statistical values determined by experiments.

$$(C*\text{Outside Temperature})+D \quad \text{Equation 3}$$

Based on a comparison between an estimated first refrigerant flow velocity and an estimated second refrigerant flow velocity, the controller may control the flow rate control valve to be opened so that a gas refrigerant can flow from the evaporator to the compressor. Specifically, when the first refrigerant flow velocity is not greater than the second refrigerant flow velocity at a predetermined ratio or more relative thereto, the controller may control the flow rate control valve to be opened, so that the gas refrigerant flows from the evaporator to the compressor. Alternatively, when the first refrigerant flow velocity is not greater than the second refrigerant flow velocity at the predetermined ratio or more relative thereto, the controller may control the flow velocity control valve to be closed, so that the gas refrigerant is prevented from flowing to the compressor. At this point, the predetermined ratio, which is a ratio that takes into consideration a margin between the first refrigerant flow velocity and the second refrigerant flow velocity, may be a value set for reliability. For example, in the case where it is determined that reliability is ensured when the first refrigerant flow velocity is 10% greater than the second refrigerant flow velocity, the predetermined ratio may be 1.1, and in the case where it is determined that reliability is ensured when the first refrigerant flow velocity is 20% greater than the second refrigerant flow velocity, the predetermined ratio may be 1.2.

In addition, the controller may open or close the flow rate control valve according to a degree of discharge superheat. The degree of discharge superheat, which is a difference between a discharge temperature of the compressor and a condensation temperature of a refrigerant, may be a difference between a temperature measured in the compressor and a temperature measured in the condenser. Specifically, when the degree of discharge superheat is equal to or greater than a first preset degree of discharge superheat, the controller may open the flow rate control valve and thus the gas refrigerant may flow from the evaporator to the compressor. When the degree of discharge superheat is equal to or less than a second preset degree of discharge superheat, the controller may close the flow rate control valve and thus the gas refrigerant may not flow from the evaporator to the compressor. For example, in the case where the first degree of discharge superheat is set to 19° C. and the second degree of discharge superheat is set to 15° C., if a measured degree of discharge superheat is 20° C., the flow rate control valve may be opened so that gas refrigerant flows to the compressor. However, when the degree of discharge superheat is measured as 13° C., the flow rate control valve may be closed so that the gas refrigerant is prevented from flowing to the compressor. Alternatively, when the degree of discharge superheat changes from 20° C. to 17° C., the opened flow rate control valve may remain open, but when the degree of discharge superheat changes from 20° C. to 13° C., the opened flow rate control valve may be closed. At this point, the first degree of discharge superheat and the second degree of discharge superheat may be statistical values that are preset in consideration of reliability of the air conditioner.

In addition, when a preset period of time has elapsed since activation of the air conditioner or when the preset period of time has not elapsed since closing of the flow rate control valve, the flow rate control valve may not be opened. At this point, the preset period of time may be a statistical value that is preset in consideration of reliability of the air conditioner. For example, when 10 minutes have not elapsed since activation of the air conditioner, the flow rate control valve may not be opened. In addition, when 5 minutes have not elapsed since closing of the flow rate control valve, the flow rate control valve may not be opened.

In addition, the flow rate control valve may be opened when the outside temperature is equal to or less than a first preset temperature, or the flow rate control valve may be closed when the outside temperature is equal to or higher than a second preset temperature. At this point, the second temperature may be a value determined in consideration of the first temperature and a hysteresis gap. For example, in the case where the first temperature is set to 10° C. and the second temperature is set to 13° C., the flow rate control valve may be opened when the outside temperature is 9° C., and the flow rate control valve may be closed when the outside temperature is 14° C. Alternatively, if the outside temperature changes from 9° C. to 12° C., the opened flow rate control valve may remain opened, but if the outside temperature changes from 9° C. to 14° C., the opened flow rate control valve may be closed.

As described above, when a specific condition is satisfied, the flow rate control valve included in the gas-liquid separator may be opened to guide gas refrigerant to the compressor, and when a different condition is satisfied, the flow rate control valve may be closed to prevent gas refrigerant from being guided to the compressor. When at least one of the refrigerant flow velocity, the degree of discharge superheat, the outside temperature, and the elapse of the preset period of time is satisfied, the flow rate control valve may be opened or closed.

Figure 7:
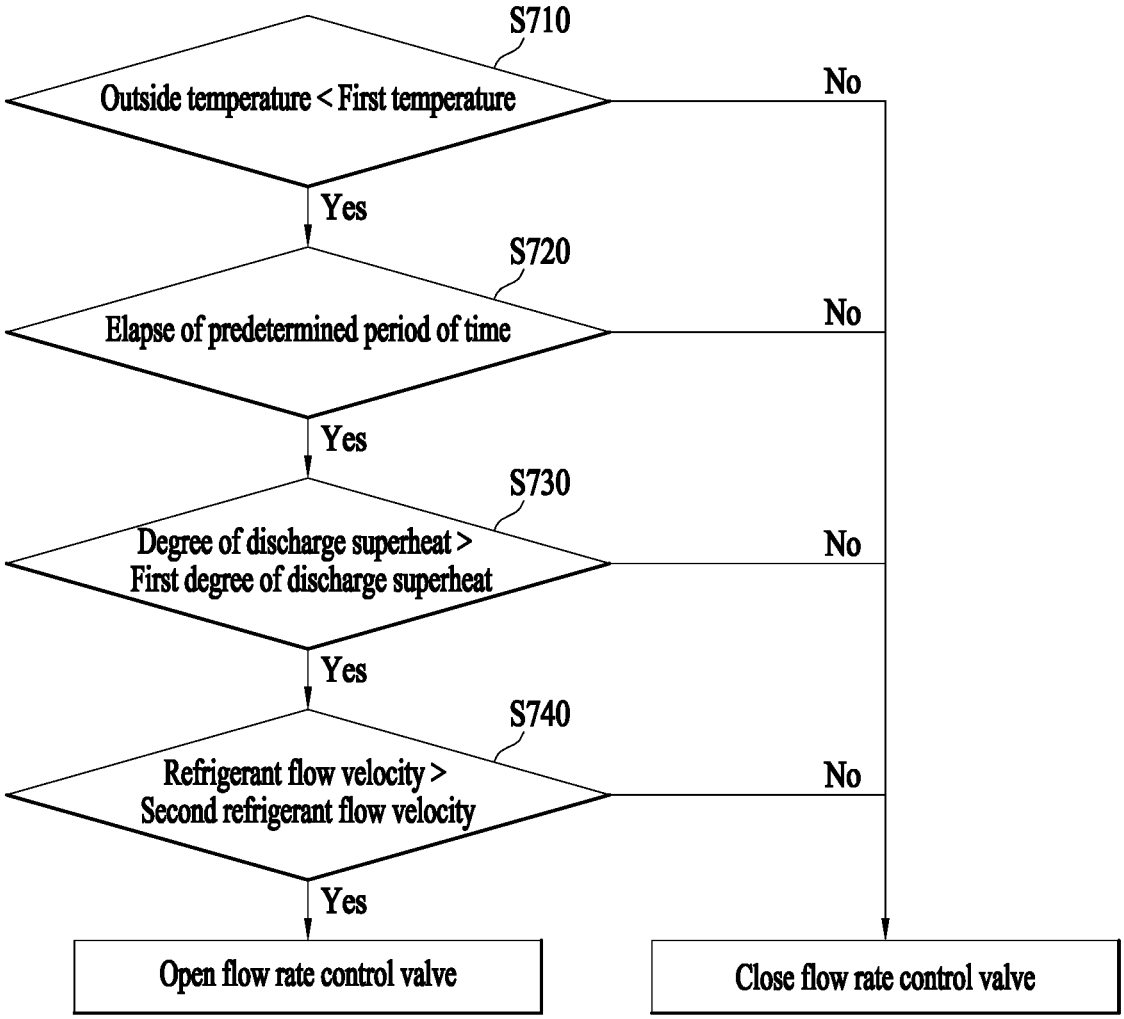
FIG. 7 is a diagram illustrating a control of a flow rate control valve installed on a bypass pipe according to another embodiment.

FIG. 7 is a diagram illustrating a control of a flow rate control valve installed on a bypass pipe according to another embodiment. For the common part of FIGS. 6 and 7, the description of FIG. 6 described above may be referred to.

An outside temperature in the outside of the air conditioner may be monitored. In addition, an operation time of the air conditioner may be monitored, and a degree of discharge superheat may be monitored based on the compressor and the condenser. Also, a refrigerant flow velocity of a refrigerant flowing inside a refrigerant pipe of the air conditioner may be estimated.

Specifically, the controller may identify whether an outside temperature is less than the first temperature in operation S710, the controller may identify whether a preset period of time has elapsed since activation of the air conditioner in operation S720, the controller may identify whether a degree of discharge superheat is greater than a first preset degree of discharge superheat in operation S730, and the controller may identify whether the refrigerant flow velocity is greater than a second refrigerant flow velocity at a predetermined ratio or more relative thereto in operation S740.

For example, the controller may control the flow rate control valve to be opened when the outside temperature of the air conditioner is less than the first temperature, when the preset period of time has elapsed since activation of the air conditioner, when the degree of discharge superheat is greater than the first degree of discharge superheat, and when the refrigerant flow velocity is greater than the second refrigerant flow velocity at a predetermined ratio or more relative thereto. In another example, the controller may control the flow rate control valve to be closed when the outside temperature of the air conditioner is less than the first temperature, when the preset period of time has elapsed since activation of the air conditioner, or when the degree of discharge superheat is less than the first degree of discharge superheat.

Figure 8:
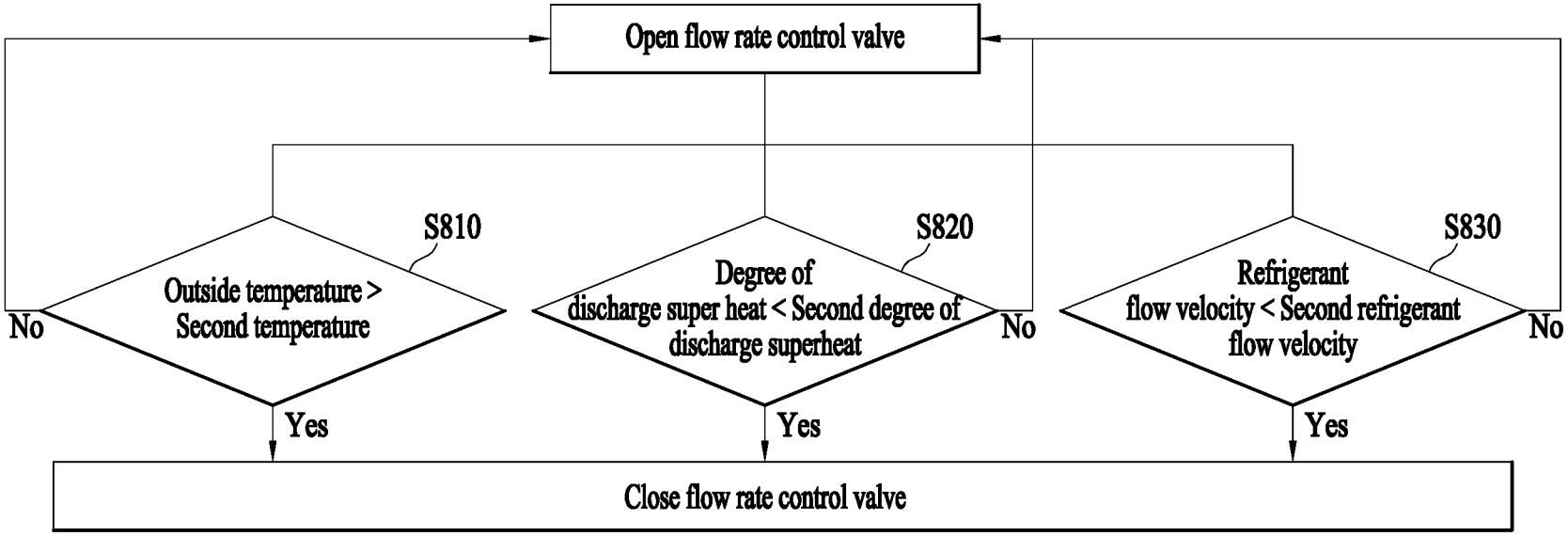
FIG. 8 is a diagram illustrating a control of a flow rate control valve installed on a bypass pipe according to another embodiment.

FIG. 8 is a diagram illustrating a control of a flow rate control valve installed on a bypass pipe according to another embodiment. For the common parts of FIGS. 6 and 8, the description of FIG. 6 described above may be referred to.

When the flow rate control valve is opened, the controller may identify whether an outside temperature of the air conditioner is greater than a second temperature in operation S810. When the outside temperature of the air conditioner is greater than the second temperature, the controller may close the opened flow rate control valve. Alternatively, when the outside temperature is less than the second temperature, the controller may maintain the flow rate control valve opened.

In addition, when the flow rate control valve is opened, the controller may identify whether a degree of discharge superheat of the air conditioner is less than a second degree of discharge superheat in operation S820. When the degree of discharge superheat of the air conditioner is less than the second degree of discharge superheat, the controller may close the opened flow rate control valve. Alternatively, when the degree of discharge superheat is greater than the second degree of discharge superheat, the controller may maintain the flow rate control valve opened.

In addition, when the flow velocity control valve is opened, the controller may identify whether an estimated refrigerant flow velocity of a two-phase refrigerant flowing inside a refrigerant pipe is less than the second refrigerant flow velocity at a predetermined ratio or more relative thereto in operation S830. If the estimated refrigerant flow velocity is not greater than the second refrigerant flow velocity at the predetermined ratio or more relative thereto, the controller may close the opened flow rate control valve. Alternatively, if the estimated refrigerant flow velocity is greater than the second refrigerant flow velocity at the predetermined ratio or more relative thereto, the controller may maintain the flow rate control valve opened.

Figure 9:
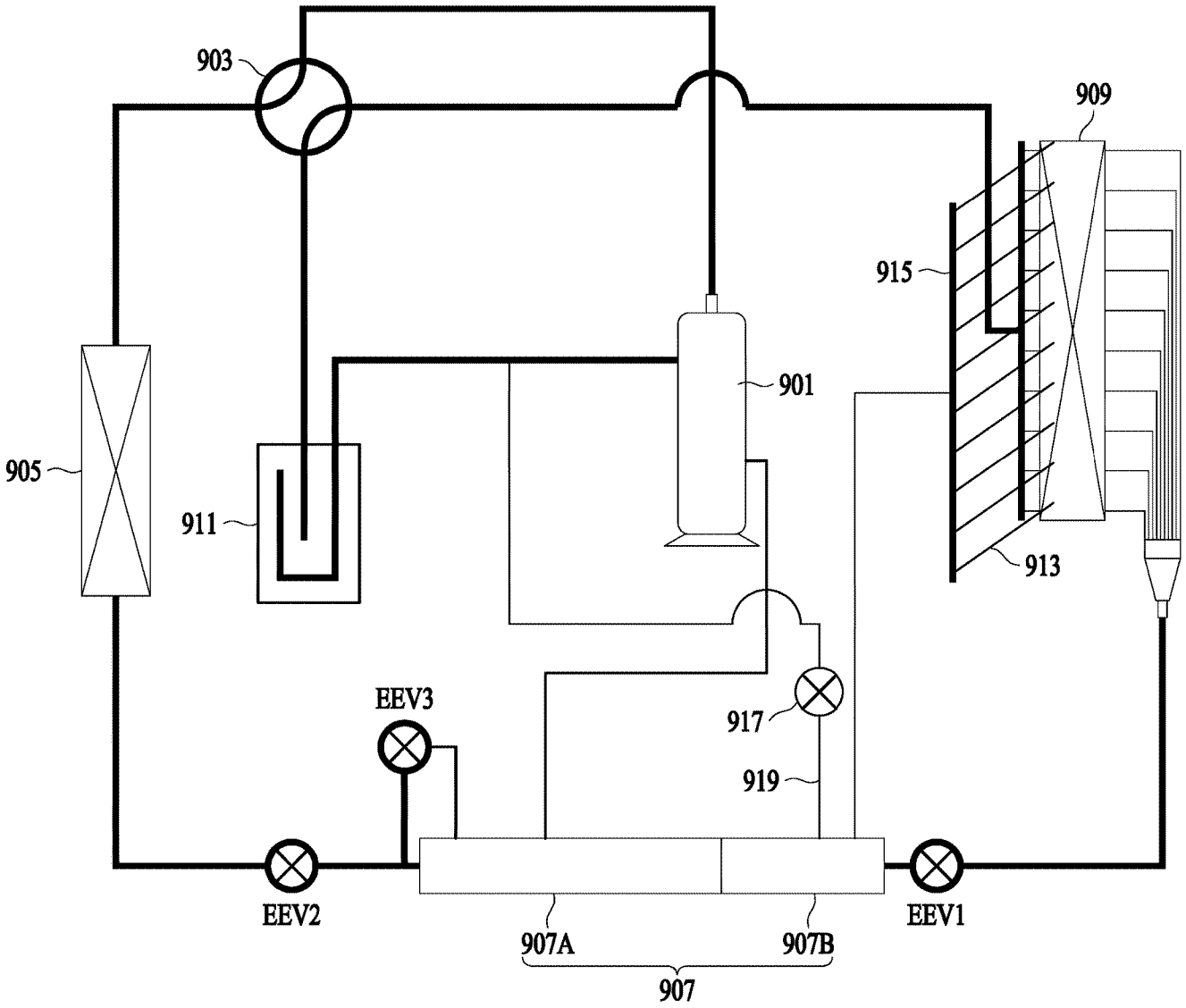
FIG. 9 is a diagram illustrating a system of an air conditioner according to an embodiment different from the embodiment of FIG. 3.

FIG. 9 is a diagram illustrating a system of an air conditioner according to an embodiment different from the embodiment of FIG. 3. For the common part of FIGS. 3 and 9, the description of FIG. 3 described above may be referred to.

A subcooler 907 may include a first subcooler 907A and a second subcooler 907B. In this case, the first subcooler 907A may be a subcooler passed by a second bypass pipe, which is a refrigerant pipe connecting the compressor and the electronic expansion valve EEV3, and the second subcooler 907B may be a subcooler passed by a first bypass pipe 919 connected to the evaporator. One end of the second bypass pipe may be connected to a refrigerant pipe between the electronic expansion valve EEV2 and the subcooler 907A, and the other end of the second bypass pipe may be connected to a compressor 901. For a detailed description of the second bypass pipe, the description of FIG. 3 described above may be referred to.

Refrigerant flowing inside the first bypass pipe 919 and the second bypass pipe may be subcooled by heat exchange with refrigerant flowing inside the subcoolers 907A and 907B. One end of the first bypass pipe 919 may be connected to a header 915, and the other end of the first bypass pipe 919 may be connected to a refrigerant pipe connecting an accumulator 911 and the compressor 901. Unlike FIG. 3, the first bypass pipe 919 of FIG. 7 may pass through the second subcooler 907B, so that the refrigerant flowing inside the first bypass pipe 919 is subcooled.

The first subcooler 907A and the second subcooler 907B may be arranged adjacent to each other in a refrigerant flow direction. The first subcooler 907A may be disposed behind the second subcooler 907B in the refrigerant flow direction in a heating operation of the air conditioner. That is, the second subcooler 907B may be disposed in front of the first subcooler 907A in the refrigerant flow direction in the heating operation of the air conditioner.

According to an embodiment, unlike FIG. 3, in FIG. 7, the first bypass pipe 919 in which a gas refrigerant separated in the evaporator flows may pass through the second subcooler 907B, so that the gas refrigerant is subcooled and flows to the compressor.

According to an embodiment of the present specification, one or more of the following effects are provided.

First, it is possible to improve efficiency of the air conditioner by a pressure loss reduction using a gas-liquid separator that extracts a gas refrigerant from a two-phase refrigerant, flowing inside an evaporator, in a heating operation of the air conditioner.

Second, it is possible to improve reliability of the air conditioner by controlling a flow rate control valve included in the gas-liquid separator based on a flow pattern of the two-phase refrigerant flowing inside the evaporator. In this case, if the flow rate control valve is opened, the gas refrigerant is extracted in the evaporator and supplied to the compressor, thereby improving efficiency of the air conditioner by a pressure loss reduction.

Third, it is possible to improve the reliability of the air conditioner by controlling the flow rate control valve included in the gas-liquid separator based on degree of discharge superheat of the air conditioner and the outside temperature.

Effects of the present disclosure are not limited to the effects mentioned above, and other effects not mentioned will become apparent to those skilled in the art from the description of the claims.

Although various embodiments of the present disclosure have been described using specific terms, the specification and drawings are to be regarded in an illustrative rather than a restrictive sense in order to help understand the present disclosure. It is obvious to those skilled in the art that various modifications and changes can be made thereto without departing from the broader spirit and scope of the present disclosure. It is obvious to those skilled in the art to which the present disclosure pertains that other modified embodiments based on the technical idea of the present disclosure besides the embodiments disclosed herein can be carried out.

What is claimed is:

1. A gas-liquid separator comprising:

a connection pipe connected to a refrigerant pipe of an evaporator, the refrigerant pipe being configured to carry a two-phase refrigerant;

a header connected to the connection pipe and configured to receive a gas-phase refrigerant separated from the two-phase refrigerant in the refrigerant pipe;

a bypass pipe connected to the header and configured to guide the gas-phase refrigerant to a compressor;

a flow rate control valve installed at the bypass pipe; and a controller configured to selectively open and close the flow rate control valve based on a preset condition, wherein the two-phase refrigerant comprises a liquid-phase refrigerant and the gas-phase refrigerant, and wherein the controller is configured to:

estimate a first refrigerant flow velocity and a second refrigerant flow velocity of the two-phase refrigerant based on at least one of a type of the compressor, an operation frequency of the compressor, a number of paths of the evaporator, or an outside temperature, and control flow of the gas-phase refrigerant through the bypass pipe based on a comparison between the first refrigerant flow velocity and the second refrigerant flow velocity.

2. The gas-liquid separator of claim 1, wherein the controller is configured to control the flow rate control valve to maintain the bypass pipe in a closed state for a predetermined period of time since activation of an air conditioner or since closing of the flow rate control valve, the air conditioner comprising the compressor and the evaporator.

3. The gas-liquid separator of claim 1, wherein the controller is configured to:

based on an outside temperature being less than or equal to a first preset temperature, open the flow rate control valve; and based on the outside temperature being greater than or equal to a second preset temperature, close the flow rate control valve, and wherein the second preset temperature is determined based on the first preset temperature and a hysteresis gap related to a change of the outside temperature.

4. The gas-liquid separator of claim 1, wherein the controller is configured to:

based on the first refrigerant flow velocity being greater than the second refrigerant flow velocity, control the flow rate control valve to open the bypass pipe to allow the gas-phase refrigerant in the bypass pipe to flow to the compressor; and based on the first refrigerant flow velocity being less than or equal to the second refrigerant flow velocity, control the flow rate control valve to close the bypass pipe to restrict the gas-phase refrigerant in the bypass pipe from flowing to the compressor.

5. The gas-liquid separator of claim 4, wherein the first refrigerant flow velocity is an estimated flow velocity of the two-phase refrigerant flowing inside the refrigerant pipe of the evaporator, and wherein the controller is configured to:

estimate the first refrigerant flow velocity based on a ratio of the number of paths of the evaporator to a preset number of paths, the type of the compressor, and the outside temperature; and control the flow rate control valve to open the bypass pipe based on the estimated first refrigerant flow velocity corresponding to a flow velocity of an annular flow of the two-phase refrigerant in the refrigerant pipe of the evaporator.

6. The gas-liquid separator of claim 1, wherein the controller is configured to:

determine a degree of discharge superheat based on a temperature measured at the compressor and a temperature measured at a condenser connected to the compressor; and control flow of the gas-phase refrigerant through the bypass pipe based on a comparison between the degree of discharge superheat and a preset degree of discharge superheat.

7. The gas-liquid separator of claim 6, wherein the controller is configured to:

based on the degree of discharge superheat being greater than or equal to a first preset degree of discharge superheat, control the flow rate control valve to open the bypass pipe to allow the gas-phase refrigerant in the bypass pipe to flow to the compressor; and based on the degree of discharge superheat being less than or equal to a second preset degree of discharge superheat, control the flow rate control valve to close the bypass pipe to restrict the gas-phase refrigerant in the bypass pipe from flowing to the compressor.

8. The gas-liquid separator of claim 1, wherein the controller is configured to:

determine a ratio between the first refrigerant flow velocity and the second refrigerant flow velocity;

based on the ratio between the first refrigerant flow velocity and the second refrigerant flow velocity being greater than a predetermined ratio, control the flow rate control valve to open the bypass pipe to allow the gas-phase refrigerant in the bypass pipe to flow to the compressor; and based on the ratio between the first refrigerant flow velocity and the second refrigerant flow velocity being less than or equal to the predetermined ratio, control the flow rate control valve to close the bypass pipe to restrict the gas-phase refrigerant in the bypass pipe from flowing to the compressor.

9. The gas-liquid separator of claim 8, wherein the second refrigerant flow velocity corresponds to a flow velocity of the two-phase refrigerant at which the two-phase refrigerant forms an annular flow in the refrigerant pipe of the evaporator, and wherein the predetermined ratio is determined based on a difference between the first refrigerant flow velocity and the second refrigerant flow velocity.

10. The gas-liquid separator of claim 9, wherein the ratio between the first refrigerant flow velocity and the second refrigerant flow velocity is a ratio of the first refrigerant flow velocity relative to the second refrigerant flow velocity.

11. An air conditioner comprising:

a compressor configured to compress refrigerant;

a condenser configured to receive the refrigerant compressed in the compressor;

an evaporator configured to evaporate the refrigerant after passing through the condenser, the evaporator comprising a refrigerant pipe configured to carry a two-phase refrigerant;

a bypass pipe configured to guide a gas-phase refrigerant separated from the two-phase refrigerant to the compressor;

a flow rate control valve installed at the bypass pipe; and a controller configured to selectively open and close the flow rate control valve based on at least one of a plurality of conditions, the plurality of conditions comprising a first condition related to an outside temperature of the air conditioner, a second condition related to operation of the air conditioner, a third condition related to a degree of discharge superheat determined based on a temperature measured at the compressor and a temperature measured at the condenser, and a fourth condition related to a refrigerant flow velocity of the two-phase refrigerant, wherein the controller is configured to:

control the flow rate control valve to open the bypass pipe based on each of (i) the outside temperature being less than or equal to a preset temperature, (ii) an elapse of a predetermined period of time since activation of the air conditioner, (iii) the degree of discharge superheat being greater than or equal to a preset degree of discharge superheat, and (iv) an estimated flow velocity of the two-phase refrigerant being greater than or equal to a preset refrigerant flow velocity.

12. The air conditioner of claim 11, further comprising a subcooler configured to exchange heat with the refrigerant after passing through the condenser, wherein the evaporator is configured to evaporate the refrigerant after passing through the subcooler.

13. The air conditioner of claim 11, wherein the controller is configured to:

control the flow rate control valve to close the bypass pipe based on each of (i) the outside temperature being greater than or equal to the preset temperature, (ii) the degree of discharge superheat being less than or equal to the preset degree of discharge superheat, or (iii) the estimated flow velocity of the two-phase refrigerant being less than the preset refrigerant flow velocity.

14. The air conditioner of claim 11, wherein the controller is configured to:

control the flow rate control valve to close the bypass pipe based on at least one of (i) the outside temperature being greater than or equal to the preset temperature, (ii) the degree of discharge superheat being less than or equal to the preset degree of discharge superheat, or (iii) the estimated flow velocity of the two-phase refrigerant being less than the preset refrigerant flow velocity.

15. The air conditioner of claim 14, wherein the preset refrigerant flow velocity corresponds to a flow velocity of the two-phase refrigerant at which the two-phase refrigerant forms an annular flow in the refrigerant pipe of the evaporator.

16. The air conditioner of claim 14, wherein the controller is configured to:

determine a ratio of the estimated flow velocity relative to the preset refrigerant flow velocity; and control the flow rate control valve based on comparing the ratio of the estimated flow velocity to a predetermined ratio.

17. The air conditioner of claim 16, wherein the controller is configured to:

based on the ratio of the estimated flow velocity relative to the preset refrigerant flow velocity being greater than the predetermined ratio, control the flow rate control valve to open the bypass pipe to allow the gas-phase refrigerant in the bypass pipe to flow to the compressor; and based on the ratio of the estimated flow velocity relative to the preset refrigerant flow velocity being less than or equal to the predetermined ratio, control the flow rate control valve to close the bypass pipe to restrict the gas-phase refrigerant in the bypass pipe from flowing to the compressor.

18. A gas-liquid separator comprising:

a connection pipe connected to a refrigerant pipe of an evaporator, the refrigerant pipe being configured to carry a two-phase refrigerant;

a header connected to the connection pipe and configured to receive a gas-phase refrigerant separated from the two-phase refrigerant in the refrigerant pipe;

a bypass pipe connected to the header and configured to guide the gas-phase refrigerant to a compressor;

a flow rate control valve installed at the bypass pipe; and a controller configured to selectively open and close the flow rate control valve based on a preset condition, wherein the controller is configured to:

determine a degree of discharge superheat based on a temperature measured at the compressor and a temperature measured at a condenser connected to the compressor, and control flow of the gas-phase refrigerant through the bypass pipe based on a comparison between the degree of discharge superheat and a preset degree of discharge superheat.

19. The gas-liquid separator of claim 18, wherein the controller is configured to:

based on the degree of discharge superheat being greater than or equal to a first preset degree of discharge superheat, control the flow rate control valve to open the bypass pipe to allow the gas-phase refrigerant in the bypass pipe to flow to the compressor; and based on the degree of discharge superheat being less than or equal to a second preset degree of discharge superheat, control the flow rate control valve to close the bypass pipe to restrict the gas-phase refrigerant in the bypass pipe from flowing to the compressor.

* * * * *